United States Patent [19]

Honegger

[11] Patent Number: 4,709,910

[45] Date of Patent: Dec. 1, 1987

[54] REMOVABLE DIVIDER WALL CELL WHEEL APPARATUS FOR PROCESSING PRINTED PRODUCTS

[75] Inventor: Werner Honegger, Tann Rüti, Switzerland

[73] Assignee: Ferag AG, Hinwil, Switzerland

[21] Appl. No.: 12,808

[22] Filed: Feb. 9, 1987

[30] Foreign Application Priority Data

Feb. 14, 1986 [CH] Switzerland ..... 602/86

[51] Int. Cl.[4] ..... B65H 5/30

[52] U.S. Cl. ..... 270/55; 271/295; 198/470.1; 198/474.1; 198/803.7

[58] Field of Search ..... 270/54, 55, 58, 60; 271/295, 297; 198/470.1, 474.1, 803.7, 456, 614

[56] References Cited

U.S. PATENT DOCUMENTS

| | | | |
|---|---|---|---|
| 3,229,599 | 1/1966 | Lowe | 271/295 |
| 3,825,246 | 7/1974 | Elia et al. | 271/295 |
| 3,951,399 | 4/1976 | Reist | 270/58 |
| 4,058,202 | 11/1977 | Reist et al. | 270/55 X |
| 4,124,203 | 11/1978 | Muller | 270/55 |
| 4,133,521 | 1/1979 | Muller | 270/55 |
| 4,168,828 | 9/1979 | McLear | 270/58 |
| 4,398,170 | 8/1983 | Hanselt | 270/55 |
| 4,477,067 | 10/1984 | Wise | 270/55 |
| 4,479,643 | 10/1984 | Seidel | 270/55 |

*Primary Examiner*—E. H. Eickholt

*Attorney, Agent, or Firm*—Werner W. Kleeman

[57] ABSTRACT

In the substantially radially extending compartments of a cell wheel or drum of a processing apparatus for processing printed products, there are inserted removable divider or partition walls. The removable divider or partition walls divide each of the compartments into two feed channels. These divider or partition walls terminate at a predetermined distance or spacing from the floor of the compartments. Feed structure, such as grippers for advancing the printed products are arranged in the region of the floor of each compartment and such feed structure commonly coacts with both feed channels. A printed product is inserted into each feed channel. Both printed products are conjointly advanced in the longitudinal direction of the compartments by the related product feed structure and these products are simultaneously opened and furnished with inserts. The opening of the printed products and the stuffing of inserts is done separately. The divider or partition walls can be removed without difficulty, whereby the number of reception spaces or regions (feed channels) for printed products is reduced by one half.

7 Claims, 11 Drawing Figures

REMOVABLE DIVIDER WALL CELL WHEEL APPARATUS FOR PROCESSING PRINTED PRODUCTS

CROSS-REFERENCE TO RELATED APPLICATION

This application is related to my commonly assigned, copending U.S. patent application Ser. No. 07/012,809, filed Feb. 9, 1987, and entitled "METHOD AND APPARATUS FOR INSERTING AT LEAST ONE INSERT INTO PREFERABLY FOLDED PRINTED PRODUCTS".

BACKGROUND OF THE INVENTION

The present invention broadly relates to a new and improved apparatus or drive for processing printed products, especially for inserting or stuffing inserts or supplements or the like into the printed products.

Generally speaking, the processing apparatus of the present invention comprises a cell wheel or processing drum rotatably driven about its substantially horizontal longitudinal axis. At the periphery or circumference of the cell wheel or processing drum there are located open compartments for receiving the printed products and which extend in the direction of their lengthwise axis or longitudinal direction of extent. Means for feeding or advancing transporting the printed products in the direction of the longitudinal axis of the cell wheel are provided in each cell or compartment and are operatively effective in the longitudinal direction of extent thereof.

A processing apparatus or device of this type is known from the German Patent Publication Nos. 2,447,336 and 2,604,101 and the respective corresponding U.S. Pat. No. 3,951,399, granted Apr. 20, 1976, and U.S. Pat. No. 4,058,202, granted Nov. 15, 1979. At a predetermined speed of rotation of the cell wheel or processing drum, it is possible with these known apparatuses to process a predetermined number of printed products. However, if a larger quantity of printed products should be processed, then the arriving stream of printed products must either be divided between two processing drums or cell wheels, or the speed of rotation of the processing drum or cell wheel must be increased. Increasing the speed of rotation of the processing drum or cell wheel is not possible or at best is only possible to a limited degree since any increase in the speed of rotation results in a shorter length of time in which the printed products dwell in the cell wheel or processing drum, that is to say a shorter processing time results.

SUMMARY OF THE INVENTION

Therefore, with the foregoing in mind, it is a primary object of the present invention to provide a new and improved construction of an apparatus for processing printed products or the like, especially for inserting or stuffing inserts or supplements or the like into the printed products and which apparatus which does not exhibit the aforementioned drawbacks and shortcomings of the prior art constructions.

Another and more specific object of the present invention aims at providing a new and improved construction of a processing apparatus of the previously mentioned type whose product processing capacity can be accommodated to an increased arriving quantity of printed products without large equipment expenditure and without the necessity of increasing the speed of rotation of the processing drum or cell wheel.

Yet a further significant object of the present invention aims at providing a new and improved construction of a product processing apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the product processing apparatus of the present invention is manifested by the features that removable divider or partition walls are provided for dividing each of the compartments into two feed channels for the printed products and each such divider or partition wall is located in the associated cell or compartment. These divider or partition walls are located exterior to or outside the operative region of the means for feeding or advancing the printed products and are removably attached to the processing drum or cell wheel. In each cell or compartment the means for feeding or advancing the printed products are structured for conjointly forwardly feeding or advancing the printed products stuffed or inserted into the feed channels of each associated cell or compartment.

By means of the divider or partition walls which are designed to be removable, there are provided in each compartment two feed channels for the printed products which in effect double the number of receiving spaces or regions of the processing drum or cell wheel. These removable divider or partition walls do not extend into the operative region of the means for feeding or advancing the printed products operatively associated with each cell or compartment and which serve for forwardly feeding or advancing the printed products in the direction of the longitudinal axis of the cell wheel. This permits effortless removal of the divider or partition walls when desired.

Since in each cell or compartment the means for feeding or advancing or transporting the printed products do not have their operability impaired by the divider or partition walls or, these product feeing means are capable of effectively engaging at or acting upon the printed products which are stuffed or infed substantially simultaneously into the feed channels of each compartment and conjointly forwardly feed or advance the printed products. Thus no additional feed means or facilities are necessary for advancing or forwardly feeding the two printed products in each cell or compartment. In order to increase the capacity of the processing drum or cell wheel, it is thus only necessary to insert the removable or detachable divider or partition walls. The product infeeding means for stuffing or inserting the printed products into the processing drum or cell wheel must of course be capable of inserting or stuffing an individual printed product into each feed channel to achieve the aforementioned increased product processing capacity. This preferably is accomplished by means of product infeeding devices which can infeed the printed products in packages comprising two printed products. Each printed product is individually stuffed or inserted into the feed channels of a single associated cell or compartment and these printed products are then conjointly advanced or forwardly fed by the same means for advancing or feeding the printed products of such associated compartment.

With a reduced quantity of printed products, the removable divider or partition walls can be effortless or easily removed so that a cell or compartment now only receives a single individual printed product. At an unaltered speed of rotation of the cell wheel, the processing capacity of the cell wheel is reduced in this manner by one-half. In this way the number of pages of the final or end products can be increased since the compartments are now wider or longer and can accept thicker printed products.

The aforedescribed inventive product processing apparatus is thus very simple to accommodate to the output of modern rotary printing presses. These rotary printing presses are known when printing thin printed products to operate at a greater speed than is usual during the printing of thicker printed products. The reduction of the width of the receiving spaces or regions for the printed products necessarily resulting from the division of the compartments by means of the divider or partition walls does not have a disadvantageous effect in this case, since the printed products arriving in a larger quantity are, as previously mentioned, thinner and can be easily accommodated in the narrower feed channels.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
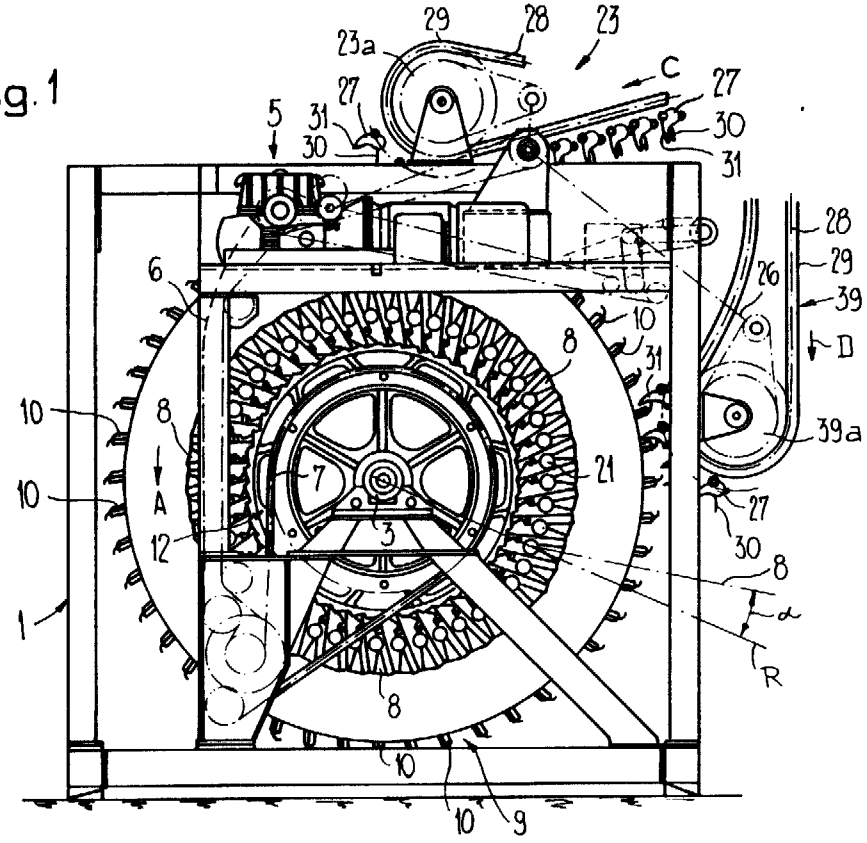
FIG. 1 is a simplified front view of a processing apparatus in partial section and with partially removed components, containing a substantially horizontally arranged longitudinal or lengthwise axis of the processing drum or cell wheel.
Figure 2:
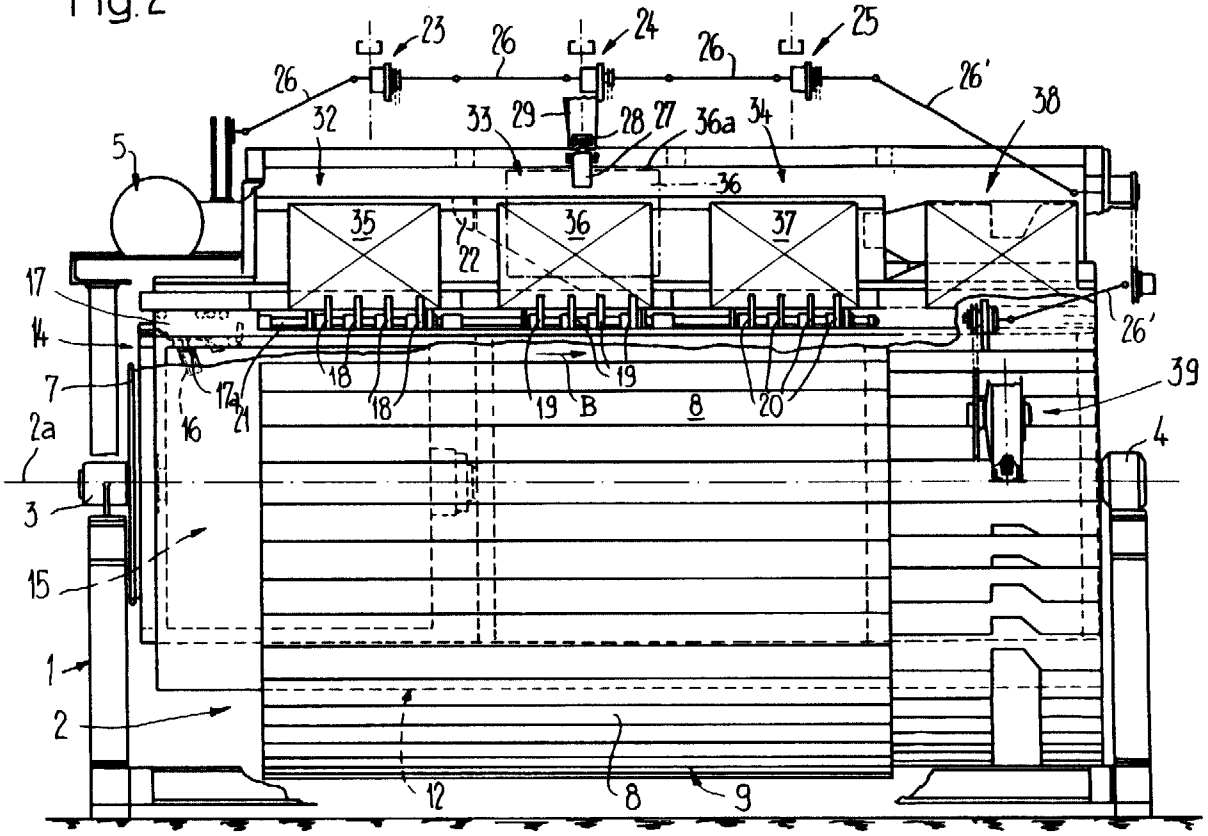
FIG. 2 is a side view in partial section and with partially removed components of the processing apparatus shown in FIG. 1.

Describing now the drawings, it is to be understood that to simplify the showing thereof only enough of the structure of the product processing apparatus for processing printed products, especially for stuffing or inserting at least one insert or supplement or the like into folded printed products or sections has been illustrated therein as is needed to enable one skilled in the art to readily understand the underlying principles and concepts of this invention. Turning now specifically to FIGS. 1 and 2 of the drawings, the product processing apparatus for printed products illustrated therein by way of example and not limitation, will be seen to comprise a processing drum or cell wheel 2 mounted in a suitable frame 1, the cell wheel 2 having a longitudinal axis 2*a* extending substantially in horizontal direction.

This processing drum or cell wheel 2 corresponds in its basic design or construction to the processing drum or cell wheel which is described in detail in the aforementioned German Patent Publication Nos. 2,447,336 and 2,604,101 and the corresponding U.S. Pat. No. 3,951,399, granted Apr. 20, 1976 and U.S. Pat. No. 4,058,202, granted Nov. 15, 1977, to which reference may be readily had and the disclosure of which is incorporated herein by reference. The above-mentioned German Patent Publications and U.S. Patents, for this reason, can be referred to as concerns the construction and function of the processing drum or cell wheel 2.

The cell wheel 2 is rotatably mounted in two bearings or journals 3 and 4. These bearings or journals 3 and 4 are mounted at the frame 1. The frame 1 further supports a drive or drive means 5 comprising a suitable motor and transmission or gear unit. The drive or drive means 5 rotatably drives the cell wheel 2 in the direction of the arrow A by means of a conventional drive chain 6 which is thus only schematically illustrated in FIG. 1. The drive chain 6 travels over a sprocket wheel 7. This sprocket wheel 7 is operatively associated or connected with the cell wheel 2.

Figure 4:
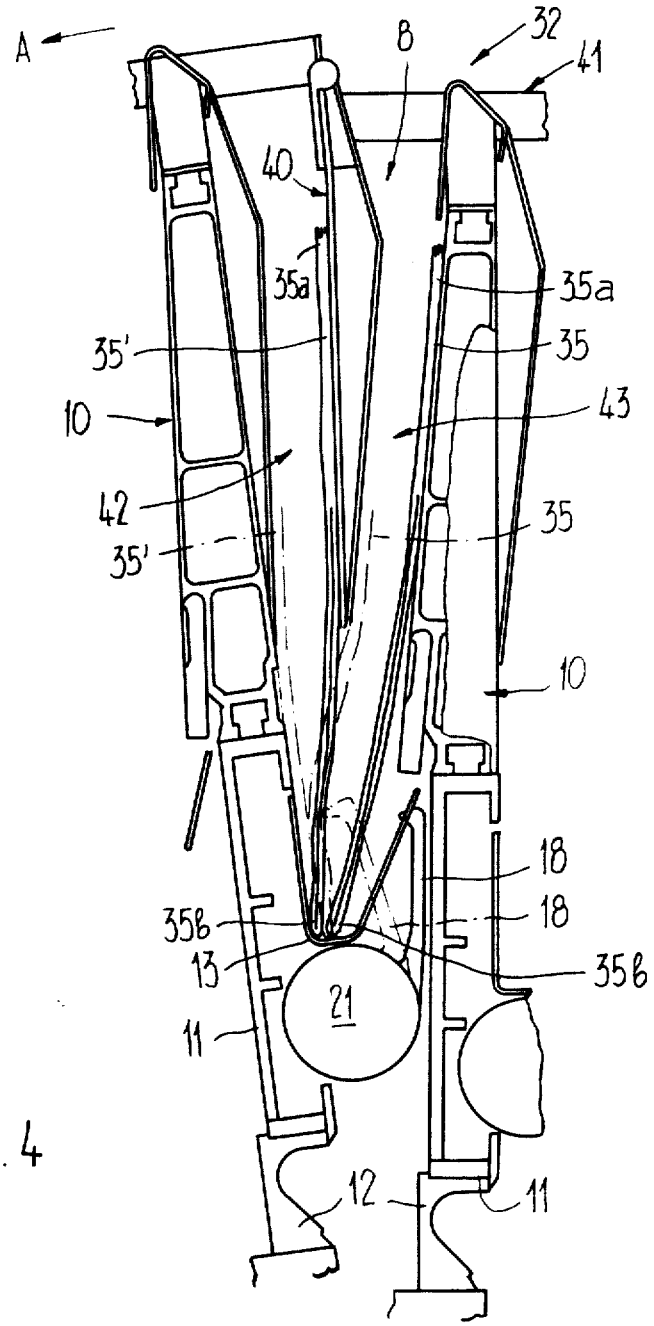
FIGS. 4, 5 and 6 are respective sections in enlarged scale of a cell or compartment of the processing drum or cell wheel at locations which are displaced from one another in the axial or lengthwise direction of the processing drum or cell wheel.
Figure 5:
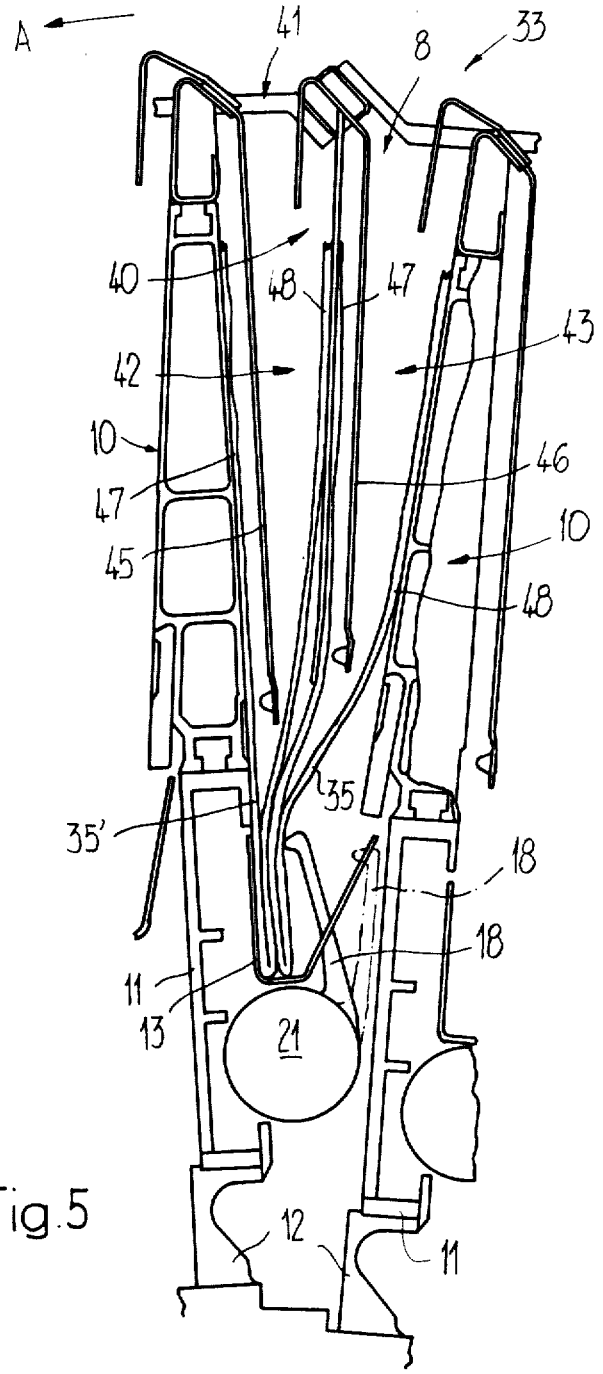
Figure 6:
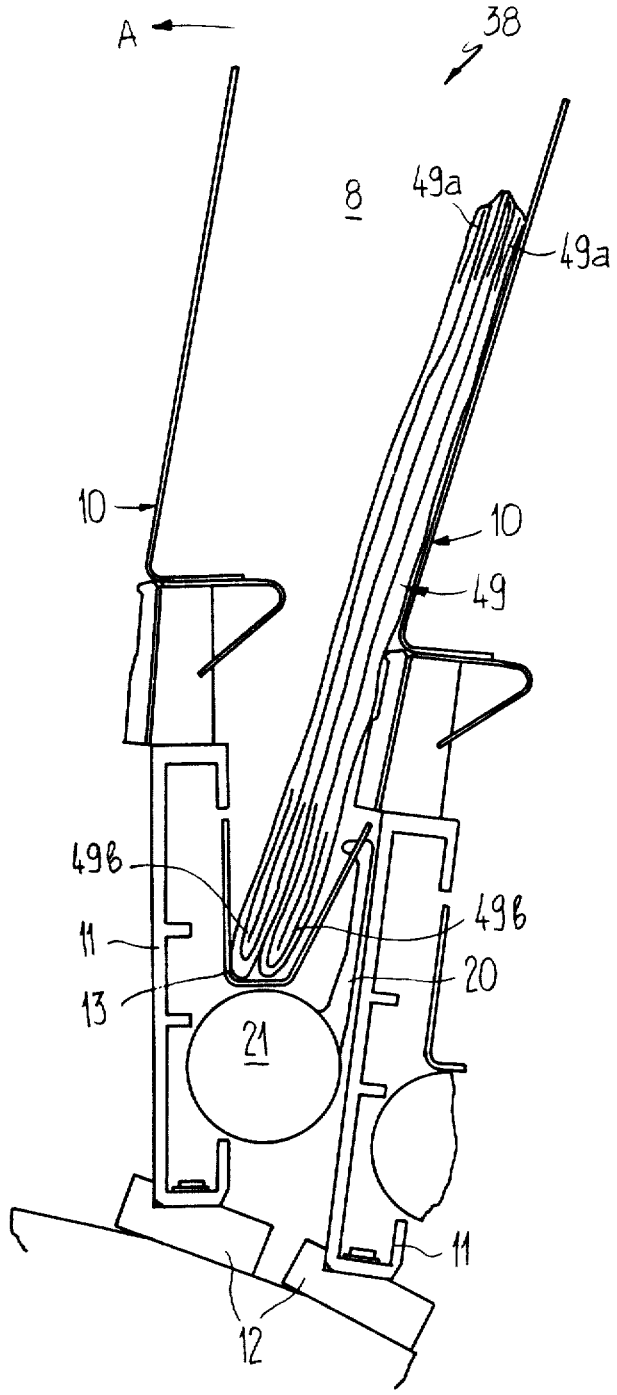
Figure 7:
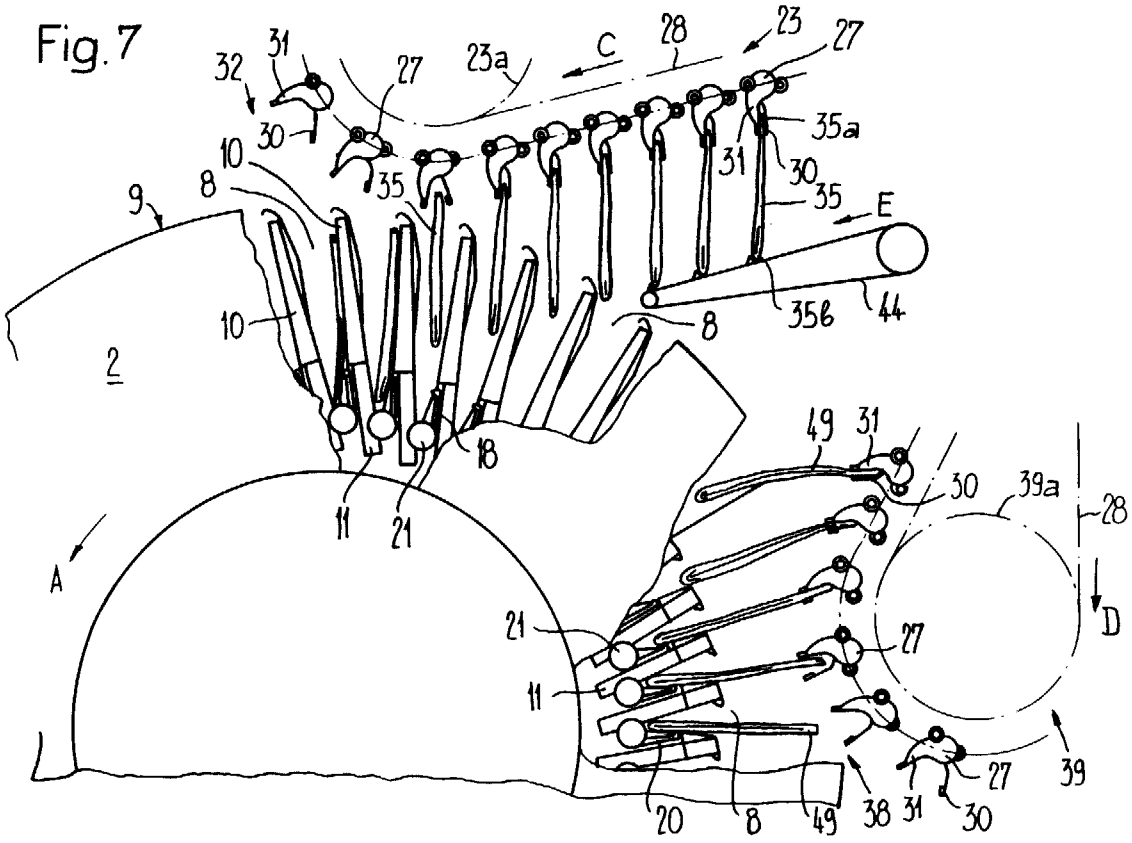
FIG. 7 is an illustration of the processing apparatus corresponding to the showing of FIG. 3 but without insertion of the removable divider or partition walls.
Figure 8:
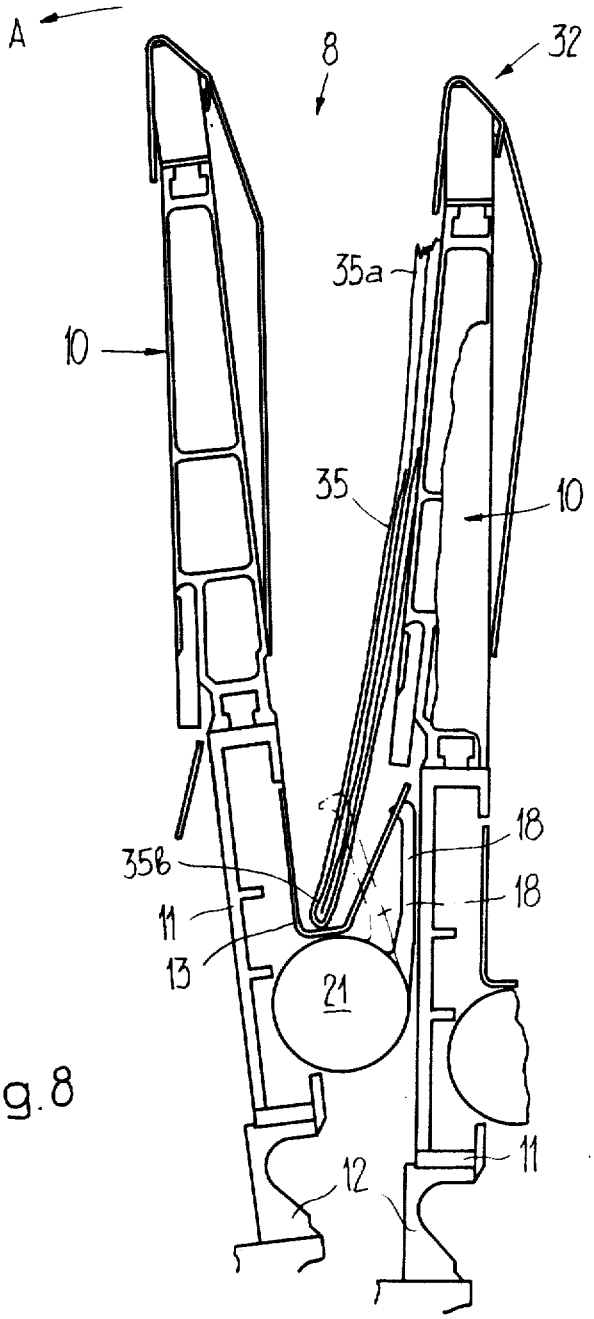
FIGS. 8, 9 and 10 illustrate respective sections corresponding with the showing of FIGS. 4, 5 and 6, respectively, and through the compartments or cells of the processing drum or cell wheel according to FIG. 7.
Figure 9:
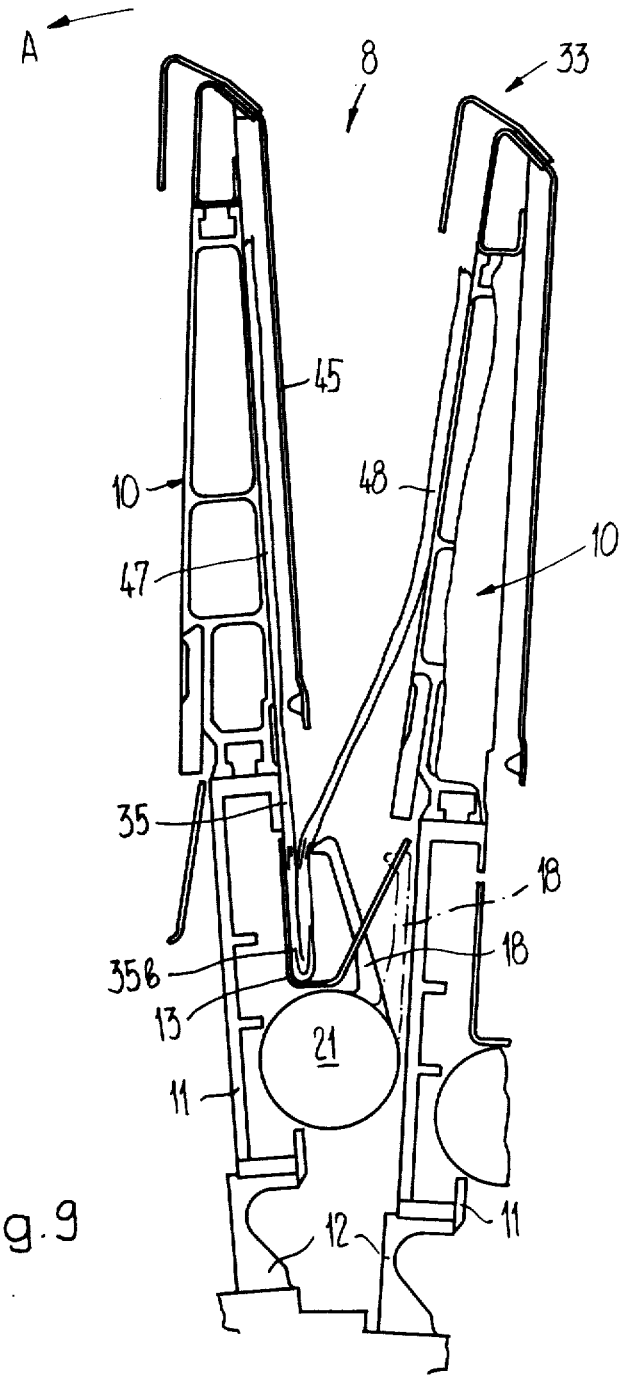

The cell wheel 2 comprises a plurality of compartments or cells 8. These compartments 8 extend radially inwardly in the direction of the longitudinal or lengthwise axis 2*a* of the cell wheel 2 and are open at the circumference or periphery 9 of the cell wheel 2. Adjacent compartments 8 are separated from one another by means of separation walls or partitions 10. These separation walls 10 are attached to substantially C-shaped or profile rails or tracks 11 (cf. FIG. 4). The substantially C-shaped profile rails 11 are connected with a base member or body 12 of the cell wheel 2, as is particularly illustrated in FIGS. 4 through 6. Not illustrated in FIGS. 4 through 6 are carriages or slides 17 (see however FIG. 2) which are displaceably guided in these substantially C-shaped profile rails 11 in the direction of the longitudinal axis 2*a* of the cell wheel 2. To these carriages or slides 17 there are connected base or floor elements 13 which close off the bottom or floor portion of the compartments 8.

A suitable product feed mechanism or device 14 is provided for each compartment or cell 8. The construction and function of this product feed device 14 is well known in this art and, for instance, is described in detail in the previously mentioned German Patent Publication No. 2,604,101 and the corresponding U.S. Pat. No. 4,058,202. Reference is thus likewise made to the above-mentioned German Patent Publication and U.S. Patent for details of this product feed device 14 which, however, will be considered herein to the extent needed to better appreciate the concepts and teachings of the present development.

Associated with this product feed mechanism or device 14 is a control or cam drum 15 coaxially positioned with respect to the longitudinal axis 2*a* of the cell wheel 2. This control drum 15 does not rotate and is provided at its exterior side or outer surface with a control curve or cam 16 which is only schematically illustratedin FIG. 2. Entrainment members 17*a* of the carriages or slides 17 associated with respective cell or compartment 8 engages with the control curve or cam 16. Sets of clamps or grippers 18, 19 and 20 are connected with the carriages 17 of each cell or compartment 8. These sets of clamps or grippers 18, 19 and 20 are seated on a common shaft 21. During the rotation of the cell wheel 2, the carriages 17 are forwardly advanced or fed in the direction of the longitudinal axis 2*a* of the cell wheel 2, i.e. in the direction of the arrow B and are subsequently again returned in their associated or related compartment 8 together with the sets of clamps or grippers 18, 19 and 20 as is described in detail in the previously mentioned German Patent Publication No. 2,604,101 and the cognate U.S. Pat. No. 4,058,202. Furthermore, the shaft 21 and the sets of clamps or grippers 18, 19 and 20 which are operatively associated or connected with this shaft 21 are pivoted.

Three product infeed or conveying devices 23, 24 and 25 are arranged above the cell wheel 2. These product infeed or conveying devices 23, 24 and 25 extend substantially parallel to one another and at a mutual spacing from one another at least in the region of the cell wheel 2. These product infeed or conveying devices 23, 24 and 25 are only schematically illustrated in FIG. 2 and corresponds in their design or construction with the product infeedes or conveyors described in German Patent Publication No. 3,102,242 and the corresponding U.S. Pat. No. 4,381,056, granted Apr. 26, 1983, to which reference may be readily had and the disclosure of which is incorporated herein by reference. Each of these product infeed or conveying devices 23, 24 and 25 comprises individual actuatable or releasable clamping elements or grippers 27. These clamping elements or grippers 27 are attached to a chain 28 or the like which is rotatably driven in the direction of the arrow C. The chain 28 is guided in a channel 29 as is schematically illustrated in FIG. 1 with reference to the product infeed or conveying device 23. The chain 28 is guided over a deflection wheel or roller 23*a*. The product infeed or conveying devices 23, 24 and 25 are driven by the drive or drive means 5 by means of a suitable drive connection 26 which is only schematically illustrated in FIG. 2. The clamping elements or grippers 27 each comprise a movable clamping element or gripper 30, also referred to as a clamping jaw, which cooperates with a stationary clamping element or tongue or jaw 31.

Each of these product infeed or conveying devices 23, 24 and 25 defines a respective product infeed or conveyor section 32, 33 and 34. Primary printed products or main product sections 35 are transported or conveyed by means of the product infeed or conveying device 23 in a manner to be more fully described and at the related product infeed or conveying section 32 are inserted or stuffed into the individual compartments or cells 8. Both other product infeed or conveying devices 24 and 25 furnish, for instance, inserts or supplements, that is to say likewise supply printed products or secondary product sections 36 and 37 which at the respective product infeed or conveyor section 33 and 34, respectively are introduced into the previously opened primary printed products or main product sections 35 in the compartments 8.

A product removal or withdrawal section or portion 38 is located adjacent to the product infeed or conveying section 34. In the region of this product removal or withdrawal section 38 there is located a product removal transport or outfeed device 39 which is similarly constructed as the product infeed or conveying devices 23, 24 and 25 and similarly comprises clamping elements or grippers 27 having a respective movable or displaceable and a stationary clamping element or jaw 30 and 31. These clamping elements or grippers 27 are attached to a chain 28 which is guided over a deflection roll or roller 39*a*. The chain 28 is guided in a channel 29 and is rotatably driven in the direction of the arrow D. The product removal transport or outfeed device 39 is likewise driven by the drive or drive means 5 as is illustrated by means of the schematically shown drive connection 26'.

A divider or partition wall 40 projects radially inwardly into each cell or compartment 8. This divider or partition wall 40 is detachably or removably attached to the cell wheel 2 by means of a holder or support 41 (cf. FIGS. 4 through 6). Each compartment or cell 8 thus is divided into two feed channels or passages 42 and 43 by means of these divider or partition walls 40. The divider or partition walls 40 extend only over a portion or section of the length of the cell wheel 2 and terminate before the beginning of the product removal or withdrawal section 38. In other words, the divider or partition walls 40 only extend through the product infeed or conveyor sections 32, 33 and 34. The divider or partition walls 40 do not extend to the floor or base region of the compartments 8, but end or terminate at a distance or spacing from the base or floor elements 13 as is particularly illustrated in FIGS. 4 through 6. This means that the divider or partition walls 40 do not project into the operating region of the clamps or grippers 18, 19 and 20. The feed channels 42 and 43, which are separated from one another at their outer lying regions or portions by the divider or partition walls 40, thus merge with one another at their inner lying ends in the region of the clamps or grippers 18, 19 and 20.

The mode of operation of the previously described product processing apparatus is described in the following in conjunction with FIGS. 1 through 6.

Figure 3:
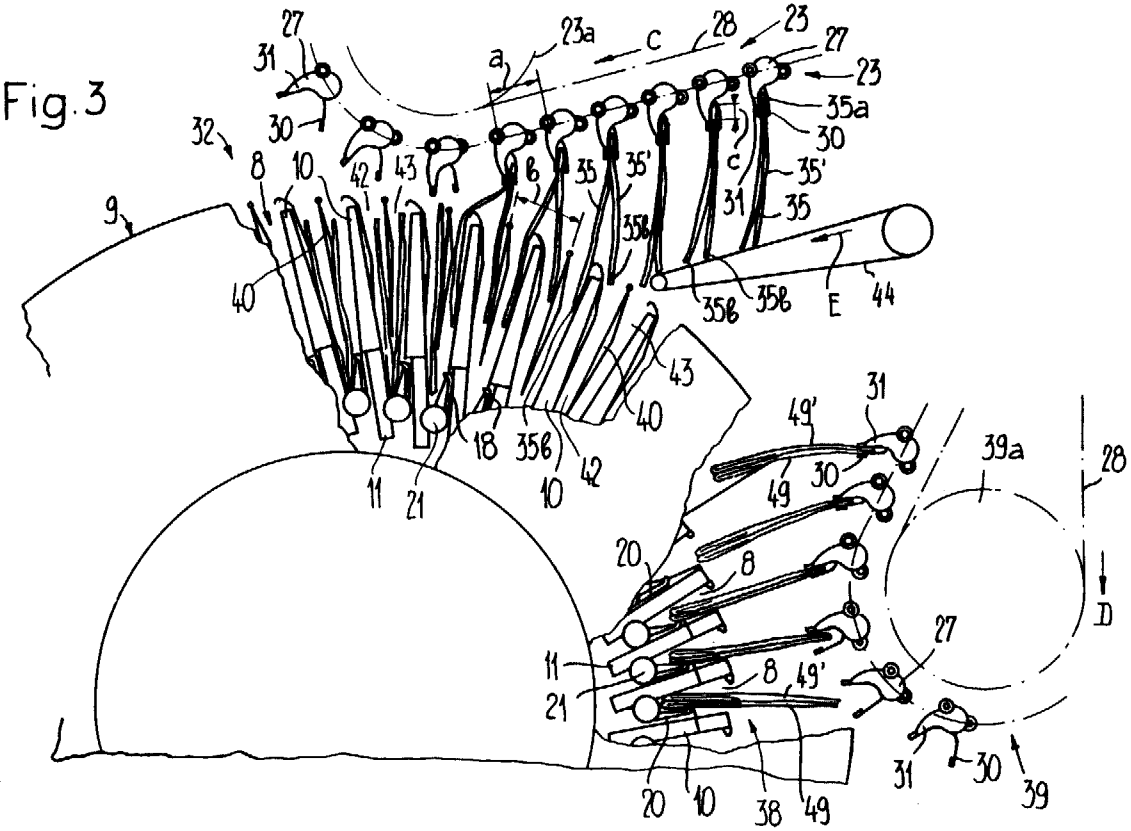
FIG. 3 is a front view in enlarged scale with respect to FIG. 1 of a portion of the processing apparatus thereof.

The distance or spacing between successive product clamps or grippers 27 of the product infeed or conveying devices 23, 24 and 25 is coordinated with the distance or spacing b of the compartments or cells 8, as shown in FIG. 3, such that during the rotation of the cell wheel 2 a respective individual compartment or cell 8 is operatively aligned with an individual clamp or gripper 27. FIG. 3 further shows that each clamp or gripper 27 of the product infeed or conveying device 23 infeeds or transports two primary or main printed products 35 and 35'. These primary printed products 35 and 35' are held in the region of their open or cut side edges which are indicated with reference numeral 35*a*.

These open or cut side edges 35*a* extend transverse to the direction of conveyance C of the product infeed or conveyor device 23. Both primary printed products 35 and 35' are also held by means of the same clamp or gripper 27 in a direction extending transverse to the previously mentioned open or cut side edge 35*a* such that they are displaced with respect to one another by a dimension or distance c so that at the oppositely situated side edge 35*b* (folded edge) one primary product 35 protrudes past the other primary printed product 35'. The cell wheel 2 is positioned before or downstream of a conveyor band or belt 44 as seen in the direction of conveyance C of the product infeed or conveying device 23 and which conveyor band or belt 44 is rotationally driven in the direction of the arrow E. The suspendedly infed primary printed products 35 and 35' come into contact at their lower or folded edges **35*b* with the conveyor belt or band 44. The primary printed products 35 and 35' are thereby stabilized in their position. After departing from the conveyor band or belt 44 both primary printed products 35 and 35', which are held in the same clamp or gripper 27, arrive at a separating wall or partition 10 which is then introduced between both primary printed products 35 and 35' as is illustrated in FIG. 3**.

The introduction or inserting of the separation wall or partition 10 and thus the mutual separation of both primary printed products 35 and 35' from one another is simplified when, as already mentioned, the primary printed product 35 protrudes past the other primary printed product 35' at the lower side edge or folded edge **35*b*. The primary printed products 35 and 35' which have now been separated from one another now arrive in the respective feed channels 43 and 42 of adjacent compartments or cells 8 as is illustrated in FIG. 4. A problem-free insertion of the primary printed products 35 and 35' into the feed channels 42 and 43 is thus assured in that the compartment or cells 8 do not extend exactly in a radial direction R (cf. FIG. 1) but are forwardly inclined or sloping with respect to this radial direction R in the rotational direction A of the cell wheel 2. The central plane 8*a* of the compartments or cells 8 forms an angle $\alpha$ with the radial direction R, as can be seen in FIG. 1**.

As soon as the primary printed products 35 and 35', which are conjointly conveyed or transported by means of the same clamp or gripper 27, are located in the feed channels 42 and 43, the associated gripper 27 is opened in a known and thus not here particularly illustrated manner, resulting in the release of the primary printed products 35 and 35'. This release of the primary printed products 35 and 35' results in such primary printed products 35 and 35' falling downwardly into the compartments or cells 8 until they come into contact with the base or floor element 13 with their lower side edges **35*b* as is illustrated in FIG. 4. Both primary printed products 35 and 35' which are located in the compartment or cell 8, are however, separated from one another by means of the divider or partition wall 40 as is illustrated in FIG. 4**.

As a result of the further rotation of the cell wheel 2 the clamps or grippers 18 are displaced into the clamping position as is illustrated in FIG. 4 in a chain dotted line and in this clamping position clamp both primary printed products 35 and 35'. The primary printed products 35 and 35' which are engaged or gripped by means of the clamps or grippers 18 in the region of their lower side edges **35*b* are now, together with these clamps or grippers 18, displaced or forwardly advanced in the direction of the arrow B towards the product infeed section 33. The primary printed products 35 and 35' thus arrive in the operative region of product opening elements 22 which project into both infeed channels 42 and 43 of which only one opening element 22 is schematically illustrated in FIG. 2**.

During the mutual forward feed or displacement of the primary printed products 35 and 35', which are located in the same cell or compartment 8, to and past the associated product opening element 22, these primary printed products 35 and 35' are simultaneously opened. Guide plates or sheets 45 and 46, for instance formed of sheet metal or plating, extend or project into each feed channel 42 and 43 downstream or behind the opening elements 22 as seen in the product transport or feed direction B. These guide plates or sheets 45 and 46 are attached to the separating wall partition 10 of the cell or compartment 8 and to the divider or partition wall 40, respectively, and extend at a distance or spacing from these walls 10 and 40, as shown in FIG. 5. These guide plates 45 and 46 engage between both product halves or sections 47 and 48 of the opened primary printed products 35 and 35'.

When the opened primary printed products 35 and 35' are located in the second product insertion or infeed section 33, i.e. in the infeed region of the product infeed or conveying device 24, the clamps or grippers 18 are pivoted back into their open or release or inactive position illustrated in a chain dotted line in FIG. 5. These clamps or grippers 18 are again displaced back or returned to the first infeed section 32 opposite the direction of product feed or conveyance B. A return movement or displacement of the primary printed products 35 and 35' is prevented by means of not particularly illustrated return stops as is further described in the previously mentioned German Patent Publication No. 2,604,101 and the corresponding U.S. Pat. No. 4,058,202. In the product infeed section 33 a first insert or supplement 36 or the like is now inserted or stuffed into each opened primary printed product 35 and 35'. These inserts or supplements 36 are conveyed or transported in pairs by means of the infeed conveyor or transport device 24 in the same manner as the primary printed products 35 and 35' and are individually introduced or stuffed into the feed channels 42 and 43 as previously described with reference to FIG. 3.

The primary printed products 35 and 35' which are furnished with these inserts or supplements 36 are now held by means of the sets of clamps or grippers 19 and again conjointly forwardly advanced or fed in the direction of the arrow B to the third product infeed section 34. During the aforedescribed operation, the primary printed products 35 and 35' remain open. The sets of clamps or grippers 19 are again returned to their release or open or inactive position at this third infeed section 43 and are then displaced back or returned to the second product infeed section 33. At the third product infeed section 34 a second insert or supplement 37 or the like is now inserted or stuffed into the open primary printed products 35 and 35' which, in the same manner as the inserts or supplements 36, are fed in pairs by means of the product infeed or conveying device 25 and are individually inserted or stuffed into the feed channels 42 and 43.

The primary printed products 35 and 35', which are now furnished with both inserts or supplements 36 and 37, are now engaged by means of the sets of clamps or grippers 20 and are conjointly transported or conveyed in the direction of the arrow B into the product removal or withdrawal section 38. In this product removal or withdrawal section 38 there are no longer provided guide plates or sheets 45 and 46 and divider or partition walls 40, as can be seen from FIG. 6. The primary printed products 35 and 35' containing the inserts 36 and 37 close and come to rest or repose upon one another, that is to say become superimposed. The final or end products comprising a respective primary printed product 35 or 35' and a respective insert 36 and 37 are illustrated in FIG. 6 with reference numerals 49 and 49', respectively. In the same manner as previously described, the sets of clamps or grippers 20 rotated or pivoted into their released or opened positions are again displaced back to the product infeed section 34. Both final or end products 49 and 49' are now engaged in the region of their exterior or outer lying side edges 49a by means of a clamp or gripper 27 of the product removal transport or outfeed device 39 and are removed or conveyed in the direction of the arrow D as is illustrated in FIG. 3. Each clamp or gripper 27 of the product removal transport or outfeed device 39 thus engages two final or end products 49 and 49'.

The previously mentioned processing operation which has been described with respect to an individual cell or compartment 8 occurs in all other cells and compartments 8 in the same manner, however in a time-wise staggered fashion.

As has already been mentioned only one transport or conveying device 14 is provided per cell or compartment 8 which is common to both of the primary printed products 35 and 35' positioned in the feed channels 42 and 43. Since the divider or partition walls 40 do not extend into the operating region of the sets of clamps or grippers 18, 19 and 20, it is thus possible to remove the divider or partition walls 40 without detrimentally affecting the functioning or operation of the cell wheel 2. This permits in a simple manner the halving of the processing capacity of the cell wheel 2 without the necessity of changing the speed of rotation of the cell wheel 2 and the conveying speed of the product infeed or conveying devices 23, 24 and 25.

In FIGS. 7 through 10 which basically correspond to the illustrations in FIGS. 3 through 6, there is shown a processing drum or cell wheel 2 without the removable divider or partition walls 40.

Figure 10:
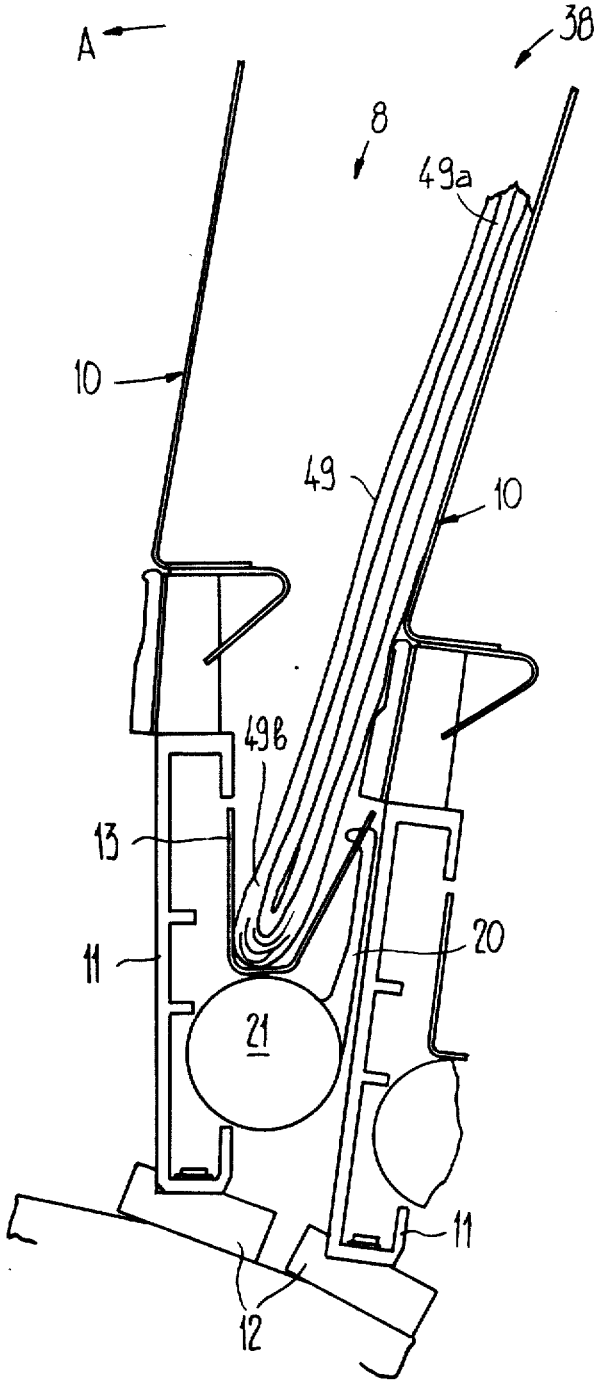

As can be seen in these FIGS. 7 through 10, only a single main product or primary printed product 35 is inserted or stuffed into each cell or compartment 8, forwardly advanced or transported as previously described, opened, and furnished with two inserts or supplements 36 and 37 or the like. FIG. 10 illustrates the end or final product 49 comprising the primary printed product or main product 35 and the inserts or supplements 36 and 37. The product infeed or conveying devices 23, 24 and 25 transport per each individual clamp or gripper 27 only a single main product or primary printed product 35 or only one respective insert or supplement 36 and 37, as the case may be.

The division of the compartments or cells 8 by the divider or partition walls 40 results in the feed channels 42 and 43 being only approximately half as wide as the cell or compartment 8. Thus less space is available for the printed products 35 to be processed with the divider or partition walls 40 inserted. This, however, is not disadvantageous, since an increase of the processing capacity of the cell wheel or processing drum 2 by mounting or attaching the divider or partition walls 40 is usually desired if the preceding or upstream located rotary printing press prints thin printed products at increased production speed. The rotary printing press operates slower when printing thicker printed products, so that a division or sectionalizing of the compartments or cells 8 by means of the divider or partition walls 40 as a rule is not necessary.

Figure 11:
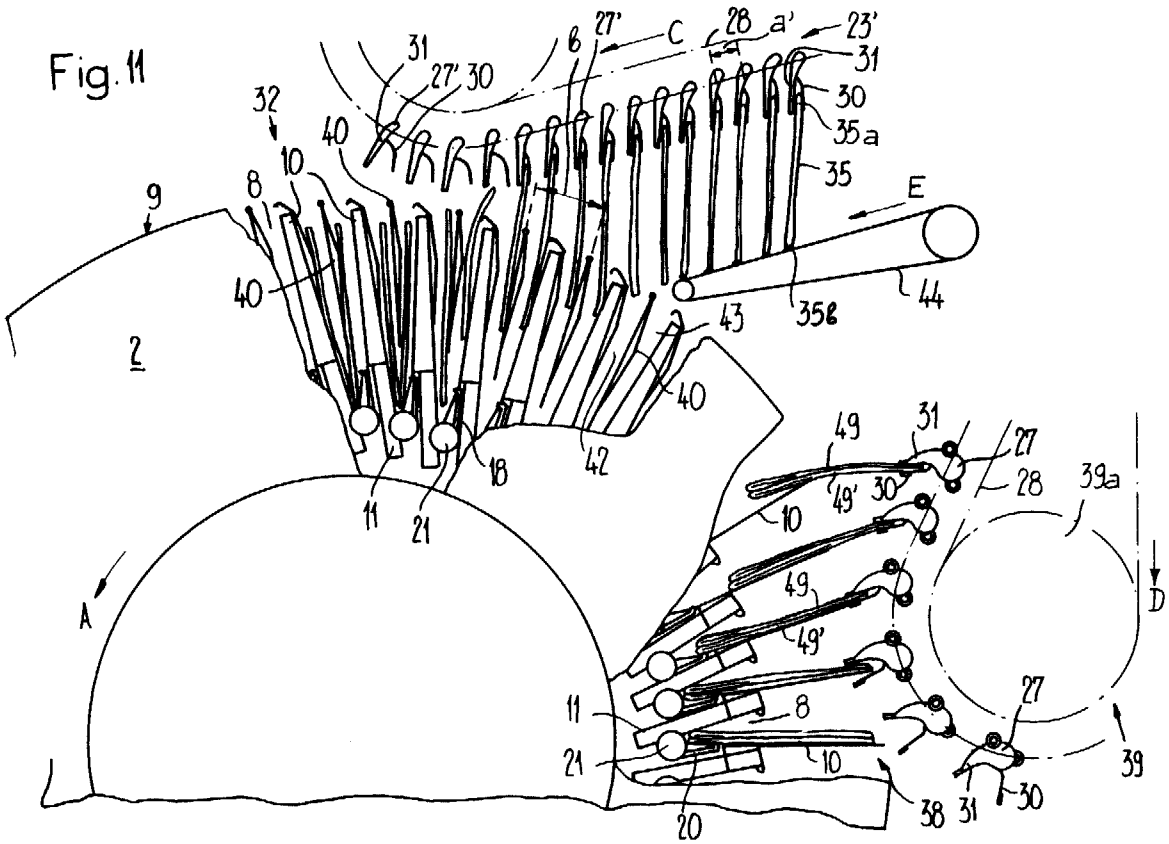
FIG. 11 is an illustration of a variant of a product processing apparatus corresponding to the processing apparatus illustrated in FIG. 3.

Another embodiment of product processing apparatus is illustrated in FIG. 11 corresponding to the illustration according to FIG. 3 which, however, differs from the embodiment according to FIG. 3 by a somewhat different design or construction of the product infeed or conveying devices 23, 24 and 25.

In the variant according to FIG. 11, the clamps or grippers 27' of the product infeed or conveying devices 23', 24' and 25' are positioned with a mutual separation or distance a' which is only approximately half as large as the distance or separation a between adjacent clamps or grippers 27 of the processing apparatus illustrated in FIG. 3. The spacing or separation i.e. pitch b of the compartments or cells 8, however, remains unchanged. Each clamp or gripper 27' now brings or transports only a single main product or primary printed product 35 or only a single insert or supplement 36 or 37, as the case may be, which is inserted or stuffed into a related feed channel 42 or 43. Also according to this embodiment, both main products or primary printed products 35 located in the feed channels 42 and 43 of a cell or compartment 8 are conjointly advanced or transported, opened and furnished with inserts or supplements, as has previously been described in detail. If the processing drum or cell wheel 2 of the embodiment shown in FIG. 11 is operated without divider or partition walls 40, i.e. is operated at a reduced processing capacity, only every second clamp or gripper 27' infeeds or transports a primary printed product or main product 35 or a respective insert or supplement 36 or 37, as the case may be. The main products or primary printed products 35 conjointly forwardly advanced or fed in the compartments 8, in contrast to the embodiment according to FIG. 3, are here not simultaneously but are sequentially inserted or stuffed one after another at short time intervals into the feed channels 42 and 43 .

With all the illustrated and aforedescribed embodiments, the number of receiving spaces or regions of the processing drum or cell wheel 2 and thus its processing capacity can be increased very simply and without increasing the speed of rotation of the cell wheel 2 of the processing apparatus by inserting the divider or partition walls 40 into the compartments 8. The divider or partition walls 40 are arranged outside the operating region of the product feed or conveying mechanisms in the individual compartments or cells 8. This allows a simultaneous and nevertheless separate processing of the two printed products with the existing means for forwardly advancing or feeding the printed products.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for processing printed products, especially for stuffing inserts into the printed products, comprising:

a cell wheel having a substantially horizontally extending longitudinal axis and a periphery;

means for rotatably driving said cell wheel about said substantially horizontally extending longitudinal axis;

said cell wheel comprising a plurality of compartments each having a lengthwise direction of extent;

each of said plurality of compartments being open at said periphery of said cell wheel for receiving the printed products;

means provided for each compartment for advancing the printed products in the lengthwise direction of extent of each said compartment and serving for forwardly feeding the printed products in each compartment in the direction of said substantially horizontally extending longitudinal axis of said cell wheel;

at least one removable divider wall operatively associated with each compartment;

each said removable divider wall extending into each said associated compartment of said plurality of compartments and dividing each said compartment into two feed channels for the printed products;

said means for advancing the printed products having an operative region in the associated compartment thereof;

said removable divider wall of each said associated compartment being located exterior to said operative region of said means for advancing the printed products in the associated compartment and being detachably connected to said cell wheel; and said means for advancing the printed products stuffed into said feed channels in each said associated compartment being capable of conjointly advancing the printed products in each said compartment.

2. The apparatus as defined in claim 1, further including:

means provided for said plurality of compartments for defining a respective floor of each of the compartments;

each said removable divider wall extending from the region of said periphery of said cell wheel into each associated compartment of said plurality of compartments and terminating at a predetermined distance from said floor thereof; and said means for advancing the printed products in the lengthwise direction of extent of the associated compartment operatively engaging the printed products in the region of said floor thereof.

3. The apparatus as defined in claim 1, wherein:

each said compartment of said plurality of compartments has an end region as seen in a predetermined direction in which the printed products are advanced in said compartment; and each said removable divider wall of said plurality of removable divider walls terminating prior to said end region of each said associated compartment as seen in the direction in which the printed products are advanced.

4. The apparatus as defined in claim 1, wherein:

each said compartment of said plurality of compartments is inclined with respect to a radial direction of said cell wheel as seen in the direction of rotation of said cell wheel.

5. The apparatus as defined in claim 1, further including:

at least one infeed device for the printed products located above said cell wheel;

said at least one infeed device having a product conveying direction extending transverse to said substantially horizontally extending longitudinal axis of said cell wheel; and said at least one infeed device conveying at least two printed products and inserting said two printed products individually into respective predeterminate ones of said feed channels when each said compartment is provided with a removable divider wall.

6. The apparatus as defined in claim 5, further including:

a plurality of individual actuatable clamps provided at said at least one infeed device and having a spacing coordinated in a predeterminate relationship to the spacing of said plurality of compartments such that one said individual actuatable clamp is operatively associated with said compartment;

said plurality of individual actuatable clamps engaging the printed products at a side edge extending transverse to the direction of conveying of the printed products; and each said individual actuatable clamp simultaneously carrying two printed products and depositing said two printed products, into the feed channels of two neighboring compartments and which define said respective predeterminate ones of said feed channels.

7. The apparatus as defined in claim 5, further including:

a plurality of individual actuatable clamps provided at said at least one infeed device and having a spacing coordinated in a predeterminate relationship to the spacing of said plurality of compartments;

said plurality of individual actuatable clamps engaging the printed products at a side edge extending transverse to the direction of conveying of the printed products;

each said clamp of said plurality of individual actuatable clamps engaging an individual printed product; and two neighboring clamps of said plurality of individual actuatable clamps depositing a respective printed product into the feed channels of the same compartment and which define said respective predeterminate ones of said feed channels.

* * * * *

UNITED STATES PATENT AND TRADEMARK OFFICE

CERTIFICATE OF CORRECTION

PATENT NO. : 4,709,910

DATED : December 1, 1987

INVENTOR(S) : WERNER HONEGGER

It is certified that error appears in the above-identified patent and that said Letters Patent is hereby corrected as shown below:

Column 2, line 46, after "product" please delete "feeing" and insert --feeding--

Column 5, lines 30 and 31, please delete "corresponds" and insert --correspond--

Column 5, line 32, please delete "infeedes" and insert --infeeders--

Column 12, line 22, after "with" please insert --one said compartment;--

Column 12, line 23, please delete "said compartment;"

Signed and Sealed this

Fourteenth Day of June, 1988

*Attest:*

*Attesting Officer*

DONALD J. QUIGG

*Commissioner of Patents and Trademarks*